US008528313B2

(12) United States Patent
Carroni et al.

(10) Patent No.: US 8,528,313 B2
(45) Date of Patent: Sep. 10, 2013

(54) BURNER FOR A SECOND CHAMBER OF A GAS TURBINE PLANT

(75) Inventors: Richard Carroni, Niederrohrdorf (CH); Madhavan Narasimhan Poyyapakkam, Mellingen (CH); Michal Bialkowski, Untersiggenthal (CH); Mark Andrew Willetts, Leicestershire (GB)

(73) Assignee: Alstom Technology Ltd, Baden (CH)

( * ) Notice: Subject to any disclaimer, the term of this patent is extended or adjusted under 35 U.S.C. 154(b) by 839 days.

(21) Appl. No.: 12/437,286

(22) Filed: May 7, 2009

(65) Prior Publication Data

US 2009/0277178 A1 Nov. 12, 2009

(30) Foreign Application Priority Data

May 9, 2008 (EP) ..... 08103890

(51) Int. Cl.
*F02C 3/14* (2006.01)

(52) U.S. Cl.
USPC ..... 60/39.17

(58) Field of Classification Search
USPC ..... 60/39.17, 735, 737, 748
See application file for complete search history.

(56) References Cited

U.S. PATENT DOCUMENTS

| | | | | |
|---|---|---|---|---|
| 2,635,424 | A * | 4/1953 | Szczeniowski | 60/746 |
| 2,640,321 | A * | 6/1953 | Pouchot | 60/749 |
| 5,351,477 | A | 10/1994 | Joshi et al. | |
| 5,647,200 | A * | 7/1997 | Althaus | 60/39.17 |
| 5,657,632 | A * | 8/1997 | Foss | 60/737 |
| 6,141,967 | A * | 11/2000 | Angel et al. | 60/737 |
| 6,438,961 | B2 * | 8/2002 | Tuthill et al. | 60/737 |
| 6,619,026 | B2 * | 9/2003 | Carelli et al. | 60/39.17 |
| 7,603,863 | B2 * | 10/2009 | Widener et al. | 60/735 |
| 2002/0148213 | A1 * | 10/2002 | Yu | 60/39.17 |
| 2003/0172655 | A1 | 9/2003 | Verdouw et al. | |
| 2004/0020210 | A1 * | 2/2004 | Tanaka et al. | 60/740 |
| 2004/0103663 | A1 * | 6/2004 | Haynes et al. | 60/737 |
| 2007/0227157 | A1 * | 10/2007 | Benz et al. | 60/796 |

FOREIGN PATENT DOCUMENTS

| | | | |
|---|---|---|---|
| EP | 1371906 | A2 | 12/2003 |
| JP | 60219401 | | 11/1985 |
| WO | 2006032961 | A1 | 3/2006 |

* cited by examiner

*Primary Examiner* — Ted Kim
(74) *Attorney, Agent, or Firm* — McNees Wallace & Nurick LLC

(57) ABSTRACT

The present invention relates to a burner for a combustion chamber of a gas turbine plant, with an injection device for introducing gaseous fuel into the burner. The injection device has a body which is arranged in the burner and which has at least one nozzle for introducing gaseous fuel into the burner. The body is configured as a streamlined body which has a streamlined cross-sectional profile and which extends with a longitudinal direction transversely with respect to a main flow direction prevailing in the burner. The at least one nozzle has its outlet orifice at an trailing edge of the streamlined body.

18 Claims, 2 Drawing Sheets

BURNER FOR A SECOND CHAMBER OF A GAS TURBINE PLANT

FIELD OF THE INVENTION

The present invention relates to a burner for a second combustion chamber of a gas turbine plant with sequential combustion having a first and a second combustion chamber.

BACKGROUND OF THE INVENTION

Combustion chambers of gas turbine plants are conventionally equipped with one burner or with a plurality of burners. A burner of this type may be equipped, for example for pilot operation or for stabilizing a flame front in the combustion chamber, with an injection device for introducing gaseous and/or liquid fuel into the burner. An injection device of this type comprises a body which is arranged in the burner and which has at least one nozzle for introducing the fuel into the burner. The injection device is conventionally a lance as known for example from the DE4326802, the shaft of which forms the body arranged in the burner and usually equipped with a plurality of nozzles. In this case, a configuration is customary in which the nozzles introduce the fuel radially into the burner with respect to a longitudinal mid-axis of the shaft. In interaction with an oxidizer flow flowing axially through the burner, an axial fuel deflection is obtained, and also an intensive intermixing of the fuel flow with the oxidizer flow.

While conventional burners preferably operate with natural gas which is introduced via the lance, in modern gas turbine plants there is the desire to use fuels containing hydrogen gas. Fuels containing hydrogen and also carbon monoxide can be produced, for example, by means of a partial oxidation of long-chain hydrocarbons. A fuel gas of this type may also be designated as synthesis gas or syngas.

Conventional burners are unsuitable for use with such a fuel containing hydrogen gas. In comparison with natural gas, a fuel gas containing hydrogen gas possesses markedly higher reactivity, which leads to lower ignition temperatures, shorter ignition delay times and higher flame velocities. If a highly reactive fuel of this type is used in a burner designed for natural gas, the fuel ignites before sufficient intermixing while the oxidizer gas takes place. The pollutant emissions consequently increase. Moreover, the risk of flashbacks rises. In order to remedy this, for example, the inflow velocity at which the fuel gas is introduced into the burner could be increased. In conventional burners, however, this may lead to the fuel gas possessing an increased concentration in the region of a burner wall, which ultimately may likewise lead to increased pollutant values and even flashback, at the latest in the combustion chamber.

What is needed is a burner allowing an improved intermixing of fuel and oxidizer and therefore reduced pollutant emissions, even when it is operated with a fuel containing hydrogen gas.

SUMMARY OF THE INVENTION

This is where the present invention comes in. The invention, as characterized in the claims, is concerned with the problem of specifying for a burner of the type initially mentioned an improved embodiment which is distinguished particularly in that the burner allows an improved intermixing of fuel and oxidizer and therefore reduced pollutant emissions, even when it is operated with a fuel containing hydrogen gas.

This problem is solved, according to the invention, by means of the subject matter of the independent claim. Advantageous embodiments are the subject matter of the dependent claims.

The invention is based on the general idea of using, instead of a cylindrical lance arranged coaxially in the burner, a rectilinear streamlined body which is arranged in the burner such that it extends with its longitudinal direction perpendicularly or at an inclination to a main flow direction prevailing in the burner, the at least one nozzle of this body possessing its outlet orifice at a trailing edge of the streamlined body. Streamlined bodies are distinguished by low flow resistance, which here is conducive to the throughflow of the burner. They also avoid wakes and recirculation zones in which fuel could ignite. By the at least one nozzle being arranged at the trailing edge or slightly upstream of the trailing edge, the fuel gas can be introduced into the burner, for example, in the flow direction of the oxidizer gas, thus reducing the risk of a concentration of the fuel gas in a wall region of the burner. Injection with a small angle relative to the main flow direction is possible, as long as recirculation of fuel gas due to eddies, which can form in the wake of fuel jet penetrating into the main flow, is avoided.

The streamlined body expediently extends over the entire height of a flow cross section of the burner. By virtue of this type of construction, the streamlined body extends from one portion of the burner wall as far as an opposite wall portion, without additional holding devices being required. As a result, a homogeneous flow profile over the entire height of the flow cross section and therefore constant introduction conditions over the entire length of the streamlined body can be implemented. Overall, the introduction of fuel can also thereby be equalized.

According to a particularly advantageous embodiment, the burner may additionally be provided with introduction devices for introducing additional media, for example a further fuel or a carrier gas, the introduction devices introducing the additional media into the burner via at least one outlet orifice which is likewise arranged at the trailing edge of the streamlined body. In the case of a carrier gas, which may likewise be an oxidizer gas, in particular air, the intermixing of fuel gas with oxidizer gas can be improved. To this end it can be injected at a small angle relative to the main flow. Further, the carrier gas is typically cooler than the main airflow. It can therefore increase the ignition delay time of the fuel gas in the oxidizer flow and thereby increase the time available for mixing. Further, it can serve to cool the streamlined body.

Further important features and advantages of the present invention may be gathered from the subclaims, from the drawings and from the accompanying figure description with reference to the drawings.

BRIEF DESCRIPTION OF THE DRAWINGS

Exemplary embodiments of the invention are illustrated in the drawings and are explained in more detail in the following description, the same reference symbols referring to identical or similar or functionally identical components.

DETAILED DESCRIPTION OF THE INVENTION

Figure 1:
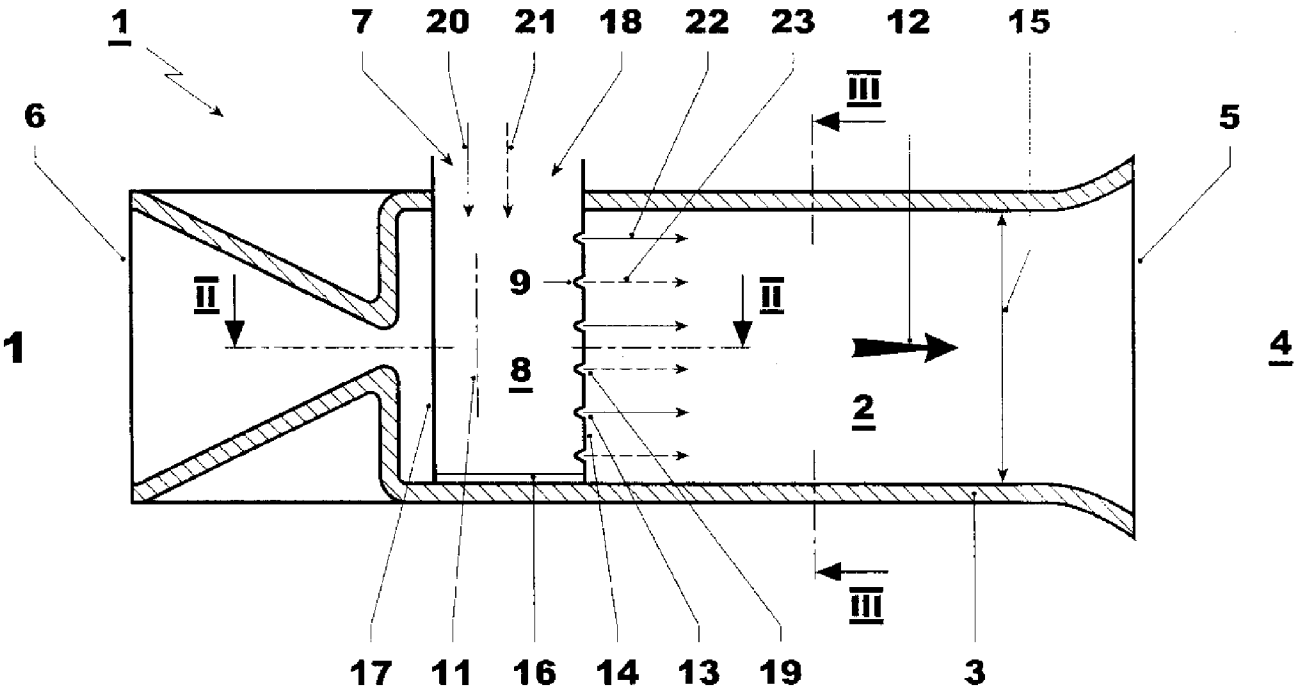
FIG. 1 shows a greatly simplified longitudinal section of a burner.

According to FIG. 1, a burner 1 comprises a mixing space 2 which is delimited by a burner wall 3. The burner 1 expediently forms an integral part of a combustion chamber, of which only a combustion space 4 is indicated here. Said combustion space 4 adjoins an outlet side 5 of the burner 1, through which a gas flow can emerge from the mixing space 2 and into the combustion space 4. Furthermore, the burner 1 has an inlet side 6, through which, when the burner 1 is in operation, an oxidizer flow, preferably an air flow, enters the mixing space 2 of the burner 1.

The burner 1, moreover, has an injection device 7, with the aid of which a gaseous fuel is introduced into the burner 1 or into its mixing space 2. The fuel is, in particular, a fuel which contains hydrogen gas and, in particular, carbon monoxide gas and which can be produced synthetically, for example by coal gasification.

Figure 2:
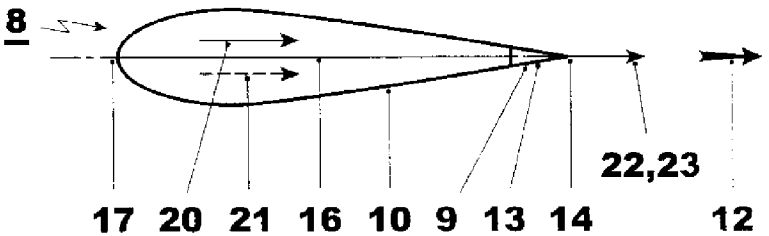
FIG. 2 shows a cross section, corresponding to the sectional lines II in FIG. 1, through a streamlined body arranged in the burner.

The injection device 7 has a body 8 which is arranged in the burner 1, that is to say in the mixing space 2, and which has at least one nozzle 9 for introducing the fuel. According to the present invention, the body 8 is a streamlined body which is designated below as the streamlined body 8. The streamlined body 8 is characterized by a streamlined cross-sectional profile 10 which can be seen in the sectional view of FIG. 2. The cross-sectional profile 10 is configured here as a symmetrical profile. A symmetrical profile is characterized in that, in the case of a uniform flow around it, the lifting forces occurring on both sides cancel each other out. The streamlined body 8 extends rectilinearly and is arranged in the burner 1 such that a longitudinal direction 11, indicated by a dashed and dotted line, of the streamlined body 8 extends transversely with respect to a main flow direction 12 which prevails in the burner 1 or in its mixing space 2 and which is indicated here by an arrow. The at least one nozzle 9, by means of which the injection device 7 introduces the fuel into the burner 1, possesses its outlet orifice 13 at a trailing edge 14 of the streamlined body 8. In the example, a plurality of nozzles 9 are provided which are arranged with separate outlet orifices 13 along the trailing edge 14, preferably equidistantly, next to one another.

In the example, the streamlined body 8 extends in its longitudinal direction 11 over the entire height of a flow cross section 15 of the burner 1. A uniform influencing of the flow by the streamlined body 8 over the entire height of the flow cross section 15 can thereby be implemented. This measure is conducive to as uniform an introduction of the fuel as possible and to as homogeneous an intermixing as possible between the fuel and oxidizer. The streamlined body 8 is in this case expediently arranged centrally in the burner 1 with respect to a width of the flow cross section 15. The width direction in this case extends perpendicularly with respect to the sectional direction of FIG. 1, that is to say perpendicularly with respect to the longitudinal direction 11 of the streamlined body 8. This central positioning of the streamlined body 8 also leads to an improvement in uniform fuel introduction and fuel intermixing.

The streamlined body 8 is preferably arranged in the burner 1 such that it is not at an inclination with respect to the main flow direction 12. Consequently, a straight line 16 connecting a leading edge 17 of the streamlined body 8 to the trailing edge 14 extends parallel to the main flow direction 12. By virtue of this orientation, the streamlined body 8 forms minimal flow resistance in the oxidizer gas flow, thus ultimately increasing the efficiency of the burner 1.

The special embodiment shown here has, moreover, an introduction device 18 which is configured such that a carrier gas, which, for example, may be an oxidizer gas, preferably air, can thereby be introduced into the burner 1 or into its mixing space 2. The introduction of this carrier gas expediently likewise takes place in the region of the trailing edge 14 of the streamlined body 8. For this purpose, the introduction device 18 also comprises at least one outlet orifice 19 which is arranged at the trailing edge 14. In the example, a plurality of such outlet orifices 19 are formed, spaced apart from one another, that is to say separately, along the trailing edge 14. With the aid of the carrier gas, the intermixing of the fuel gas and oxidizer gas can be improved. At the same time, the risk of a flashback can thereby be further reduced.

The feed of the at least one nozzle 9 of the injection device 7 with fuel takes place via a feed line 20 which is led up to the burner 1 from outside and is led further on inside the streamlined body 8. Correspondingly, the feed of the outlet orifices 19 of the introduction device 18 with carrier gas also takes place via a corresponding further feed line 21.

A main injection direction of the respective nozzle 9 is indicated by arrows 22. The nozzles 9 are preferably configured or arranged such that said main injection direction 22 is oriented essentially parallel to the main flow direction 12 of the burner 1. Similarly to this, a main introduction direction 23, which is indicated by broken arrows, and in which the carrier gas is introduced with the aid of the introduction device 18, may also expediently likewise be oriented parallel to the main flow direction 12.

In the example shown, a plurality of outlet orifices 13 for fuel gas and a plurality of outlet orifices 19 for carrier gas are arranged next to one another at the trailing edge 14. Depending on the wall thickness of the streamlined body 8 and the dimensions of the fuel gas feed 21, the orifices 13 might be arranged slightly upstream of the trailing edge 14. However, this is considered to be an injection at the trailing edge 14 in this context. In one embodiment two rows of outlet orifices 13 are arranged parallel and slightly upstream of the trailing edge on both sides of the streamlined body 8.

In another embodiment, at the trailing edge 14, a single outlet orifice may be provided which then extends in the form of a slit along the trailing edge 14 in the longitudinal direction 11 of the streamlined body 8. In particular, this single slit-shaped outlet orifice may be assigned a plurality of nozzles arranged next to one another and then arranged completely inside the streamlined body 8. The single outlet orifice then forms a common outlet orifice for a plurality of nozzles. A configuration of this type can be implemented for the introduction of the fuel and/or for the introduction of the carrier gas. In one embodiment a series of at least two slit-shaped outlet orifices is arranged in series and parallel to the longitudinal direction 11 of the streamlined body 8.

In another embodiment the outside walls of the streamlined body 8 do not meet at the trailing edge 14 but leave at least one slit-shaped gap, which forms the nozzle 9.

In yet another embodiment at least one slit-shaped opening is arranged in parallel to the longitudinal direction 11 slightly upstream of the trailing edge 14 on both sides of the streamlined body 8. These openings form the orifices 13 for fuel gas and the orifices 19 for carrier gas.

Figure 3:
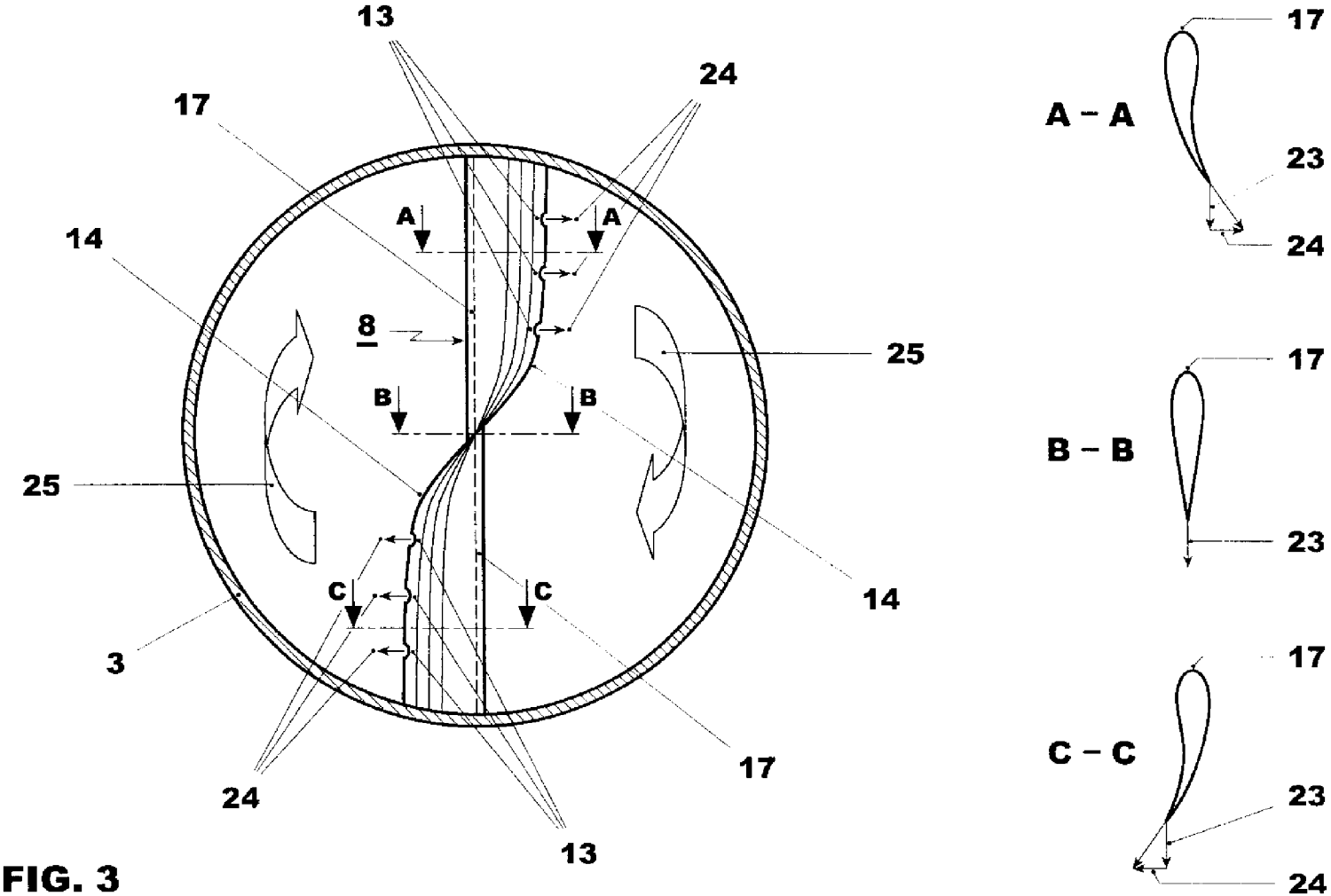
FIG. 3 shows a cross section of a cylindrical burner with a streamlined body for fuel injection, which is profiled to generate a weak swirl in the main flow.

In the embodiment shown in FIG. 3 a cylindrical burner is applied. Typically burners as shown in FIG. 1 have a rectangular or approximately rectangular cross section. However, it is also possible to use other geometrical shapes. For example a cylindrical shape as shown in FIG. 3 can be advantageous for highly reactive fuels. With the cylindrical form a more homogeneous flow without corner regions, in which the flow velocity might be reduced, can be realized. Further the cylindrical shape is advantageous for creation of a mild swirl, which enhances mixing of fluid and oxidizer.

In order to create a mild swirl the streamlined body 8 has a twisted aerodynamic profile, which is similar to that of a propeller. In the center, at its longitudinal midpoint, the profile is symmetric without any angle of attack relative to the main flow direction. In the regions between the longitudinal midpoint and the burner walls the profile has an inclination relative to the main flow direction. To produce a swirl the angle of attack of the profiles on both sides of the longitudinal midpoint are opposing each other. This can be realized for example by rotating or twisting the profile of the streamlined body 8 in opposing directions relative to the longitudinal axis 11 on both sides of the longitudinal midpoint To optimize the resulting mixing of fuel with the main flow the profiles are designed to lead to different angular speeds of the resulting flow for different distances from the centerline. For example, if the angular speed is proportional to the distance from the centre line, a virtual straight line along which the fuel gas is injected at the trailing edge of the streamlined body 8 can be twisted into a spiral by the time the flow leaves the combustor.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A burner for a second combustion chamber of a gas turbine plant with sequential combustion having a first and a second combustion chamber, the burner comprising:

a mixing space which is delimited by a burner wall and adjoins an outlet side of the burner; through which a gas flow can emerge from the mixing space into a combustion space of the second combustion chamber;

an injection device for the introduction of at least one gaseous fuel into the burner, the injection device comprising:

at least one body arranged in the burner; and at least one nozzle for introducing the at least one gaseous fuel into the burner, the at least one nozzle comprising an outlet orifice at or in a trailing edge of a streamlined body; and, wherein the at least one body is configured as the streamlined body having an uninterrupted streamlined cross-sectional profile extending in a longitudinal direction perpendicularly or at an inclination to a main flow direction prevailing in the burner;

wherein the streamlined body extends through the burner wall, continuously spans across the entire extent of a flow cross section of the burner from one portion of the burner outer wall and terminates at an opposite wall portion.

2. The burner of claim 1, wherein the streamlined body is arranged centrally in the burner with respect to a width of a flow cross section.

3. The burner of claim 1, wherein the streamlined body is arranged in the burner such that a straight line connecting the trailing edge to a leading edge extends parallel to the main flow direction of the burner.

4. The burner of claim 1, wherein a plurality of separate outlet orifices of a plurality of nozzles arranged next to one another are arranged at the trailing edge.

5. The burner of claim 1, wherein at least one slit-shaped outlet orifice, is arranged at the trailing edge.

6. The burner of claim 1, wherein a main injection direction of each nozzle is oriented parallel to the main flow direction of the burner.

7. The burner of claim 1, further comprising an introduction device for introducing a carrier gas arranged in the streamlined body.

8. The burner of claim 7, wherein at least one outlet orifice for the introduction of carrier air is provided at the trailing edge of the streamlined body.

9. The burner of claim 1, wherein the streamlined body has a symmetrical cross-sectional profile.

10. The burner of claim 1, wherein the burner has a cylindrical shape, the profile of the streamlined body is symmetric and parallel to the main flow direction at a longitudinal midpoint, and the profile of the streamlined body is rotated or twisted in opposing directions relative to the longitudinal axis on both sides of the longitudinal midpoint, in order to impose a mild swirl on the main flow.

11. A burner for a second combustion chamber of a gas turbine plant with sequential combustion having a first and a second combustion chamber, the burner comprising:

a mixing space which is delimited by a burner wall, and which adjoins an outlet side of the burner; through which a gas flow can emerge from the mixing space into a combustion space of the second combustion chamber;

an introduction device for introducing a carrier gas; and an injection device for the introduction of at least one gaseous fuel into the burner, the injection device comprising:

at least one body arranged in the burner; and at least one nozzle for introducing the at least one gaseous fuel into the burner, the at least one nozzle comprising an outlet orifice at or in a trailing edge of a streamlined body; and, wherein the at least one body is configured as the streamlined body extending through the burner wall and having an uninterrupted streamlined cross-sectional profile continuously extending in a longitudinal direction perpendicularly or at an inclination to a main flow direction prevailing in the burner from one portion of the burner outer wall and terminates at an opposite wall portion, and wherein the introduction device for introducing carrier gas is arranged in the streamlined body.

12. The burner of claim 11, wherein the streamlined body is arranged centrally in the burner with respect to a width of a flow cross section.

13. The burner of claim 11, wherein the streamlined body is arranged in the burner such that a straight line connecting the trailing edge to a leading edge extends parallel to the main flow direction of the burner.

14. The burner of claim 11, wherein a plurality of separate outlet orifices of a plurality of nozzles arranged next to one another are arranged at the trailing edge.

15. The burner of claim 11, wherein at least one slit-shaped outlet orifice, is arranged at the trailing edge.

16. The burner of claim 11, wherein a main injection direction of each nozzle is oriented parallel to the main flow direction of the burner.

17. The burner of claim 11, wherein the streamlined body has a symmetrical cross-sectional profile.

18. The burner of claim 11, wherein the burner has a cylindrical shape, the profile of the streamlined body is symmetric and parallel to the main flow direction at a longitudinal midpoint, and the profile of the streamlined body is rotated or twisted in opposing directions relative to the longitudinal axis on both sides of the longitudinal midpoint, in order to impose a mild swirl on the main flow.

* * * * *